US008920570B2

(12) United States Patent
White

(10) Patent No.: US 8,920,570 B2
(45) **Date of Patent: *Dec. 30, 2014**

(54) METHODS AND APPARATUS FOR CLEANING OILFIELD TOOLS

(71) Applicant: TRC Services, Inc., The Woodlands, TX (US)

(72) Inventor: Lonnie Dale White, Midland, TX (US)

(73) Assignee: TRC Services, Inc., The Woodlands, TX (US)

( * ) Notice: Subject to any disclaimer, the term of this patent is extended or adjusted under 35 U.S.C. 154(b) by 187 days.

This patent is subject to a terminal disclaimer.

(21) Appl. No.: 13/669,146

(22) Filed: Nov. 5, 2012

(65) Prior Publication Data

US 2014/0124001 A1 May 8, 2014

(51) Int. Cl.

| | |
|---|---|
| ***B08B 9/02*** | (2006.01) |
| ***B08B 7/04*** | (2006.01) |
| ***B08B 7/00*** | (2006.01) |

(52) U.S. Cl.

CPC ..... *B08B 7/04* (2013.01); *B08B 7/0064* (2013.01); *B08B 7/0007* (2013.01)

USPC ..... 134/6; 134/7; 134/17; 134/22.1; 134/22.11; 134/22.12; 134/22.18; 134/24; 134/30; 134/42; 451/36; 451/38; 451/40

(58) Field of Classification Search

CPC ..... B08B 9/00; B08B 9/02; B08B 9/027; B08B 9/021; B08B 9/053; B08B 9/08; B08B 9/0804; B24C 1/003; B24C 3/325; B24C 3/263; B24C 5/02; B24C 5/04

USPC ..... 451/36, 38, 40; 134/17, 22.1, 22.11, 134/22.12, 22.18, 24, 30, 42, 6, 7

See application file for complete search history.

(56) References Cited

U.S. PATENT DOCUMENTS

| | | | | |
|---|---|---|---|---|
| 4,491,484 | A * | 1/1985 | Williams | 134/4 |
| 4,494,607 | A * | 1/1985 | Ford et al. | 166/311 |
| 4,796,799 | A * | 1/1989 | Rasi-Zade et al. | 228/155 |
| 4,806,171 | A * | 2/1989 | Whitlock et al. | 134/7 |
| 5,018,667 | A | 5/1991 | Lloyd | |
| 5,660,580 | A | 8/1997 | Lehnig | |
| 6,315,639 | B1 * | 11/2001 | Kipp | 451/38 |
| 7,397,238 | B2 | 7/2008 | Walters et al. | |
| 8,187,057 | B2 | 5/2012 | Broecker | |
| 2014/0053404 | A1 * | 2/2014 | Johnson et al. | 29/888.021 |
| 2014/0124001 | A1 * | 5/2014 | White | 134/7 |

* cited by examiner

*Primary Examiner* — Bibi Carrillo

(74) *Attorney, Agent, or Firm* — Ramey & Browning, PLLC

(57) ABSTRACT

The disclosure relates to the cleaning of rods made of metal, particularly to the method of reclamation of used standard length rods, such as pump rods already used in the mechanical deep-pumping extraction of oil, as well as to the product made with the help of the mentioned method. The method of remanufacturing of standard length rods includes cleaning the rod with non-toxic particles which are able to undergo sublimation to eliminate environmental contamination and to assist in workplace safety.

16 Claims, 4 Drawing Sheets

METHODS AND APPARATUS FOR CLEANING OILFIELD TOOLS

FIELD

The embodiments of the invention disclosed herein relate to the cleaning process in the recovery or remanufacturing of oilfield equipment. More specifically, the embodiments of the invention disclosed herein relate to the cleaning of rods such as sucker rods and pony rods used in pump wells in oil fields.

BACKGROUND

A sucker rod is a rigid rod used in the oil industry to join together the surface and downhole components of a reciprocating piston pump installed in an oil well. These rods are typically between 25 and 30 feet (7 to 9 meters) in length, and threaded at both ends.

Certain methods of remanufacturing sucker rods for re-use comprise eliminating or reducing the fatigue stress in the used rods by a method involving thermally treating the rods at a temperature between about 200° C. and about 650° C. for 15 to 30 minutes. Typically this consists of normalization, upgrading or tempering, with reference to the material or rods remanufactured. After thermal treatment the rods are straightened while still hot to achieve the required straightness. Additionally, straightening while still hot allows for the removal of stress which can occur otherwise during the course of the straightening procedure.

Other methods used in the remanufacturing of rods such as sucker rods comprise the use of a device with two heads that have the ability to clamp two ends of the rod in need of treatment or modification. In this methodology, typically one head turns uncontrollably with the rod treated along its longitudinal central line. However, use of the aforementioned device can result in deformation of standard length sucker rods due to tension and torsion, even though cold working the rod's surface would improve the fatigue strength and the efficiency.

Typically the main process of reclaiming or reconditioning a used rod utilized in oil pump wells comprises obtaining the rod, cleaning the rod to remove contaminates from use in oil extraction, performing an inspection of the rod to determine if the rod should be reconditioned or discarded, categorizing the rod into steel class, heating the rod until plastic deformation, shaping the rod, cooling the rod and cutting the rod into the desired length. Embodiments of the invention pertain to a method for reconditioning a used sucker rod having a given diameter.

Typically, on pre-cleaned rods are found contaminates such as paraffin. Further, the cleaning process wherein contaminates are removed often comprises washing the rod with an organic compound. One organic compound typically used is kerosene. Other chemicals known in the art that are useful for cleaning rods are chemicals such as naptha and caustic acid. However, all of these aforementioned methods of cleaning leave toxic or caustic residue as a byproduct of the cleaning process.

Additionally, such cleaning agents may render chemicals attached to the rods soluble in organic compounds or in caustic acids. Such chemicals may themselves be toxic to the environment or pose cleanup problems at the cleaning facility.

It would therefore be advantageous to reduce the contamination to the environment and to the cleaning facility by the utilization of non-toxic cleaners and cleaners which do not result in solubility of contaminates from rods such as sucker rods. One such cleaning material is dry ice.

Cleaning via dry ice blasting is analogous to pressure washing, or sandblasting, since there is a media being moved at high speed, under pressure, to clean a specific target surface. However as compared to wet aqueous cleaning materials, dry ice is dry, thereby reducing or eliminating the short circuiting of electrical equipment or rusting bearings. Further, it is non-conductive, so it can even be used on or near energized circuits. Dry ice is also non-abrasive. Further, dry ice is attractive as a contaminant cleaner as dry ice causes no environmental harm. Rather, dry ice is a "food grade" product, meaning it can be used in food manufacturing, food preparation facilities and is FDA approved.

Because there is no secondary waste stream, dry ice blasting is advantageous from a cleaning standpoint. Typically, the only waste to clean up afterward is the grime, paraffin, rust or whatever contaminant was removed. Likewise, in the restoration applications total job time is greatly reduced due to the fact there is very little post-blast cleanup required.

There are several mechanical processes happening when dry ice particles strike a surface. Depending on the type of blasting system being used, and the air pressure and nozzle selected, the ice particles travel at speeds between 600 and 800 feet per second. Upon impact they sublimate into carbon dioxide gas. There is an expansion factor of 8× as this happens, so assuming the particles are able to initially penetrate the contaminant, this expansion occurs at the underlying substrate, thus lifting the contaminant off. There is also a thermal shock effect, as the particles are at sub-zero temperatures (−109.3 F).

Dry ice impacting a sucker rod or other pump rod surface with contaminants typically removes contaminates in one of three ways: via kinetic energy, via thermal shock or via a thermal-kinetic effect. Kinetic energy transfers the accelerated dry ice pellet as it hits the surface of the rod to be cleaned during the dry ice blasting process. The dry ice pellets sublimate upon impact. Likewise, thermal shock occurs when dry ice pellets strike a much warmer contaminated surface during the dry ice blasting. The cold temperature of the dry ice causes the bond between the surface being cleaned and the contaminants to weaken. This effect aids in the release of the contaminant when struck by the dry ice pellets during dry ice blasting. The thermal-kinetic effect combines the impact of sublimation and the rapid heat transfer discussed above. When the dry ice pellet hits the contaminated surface, the vapor expands fast enough that micro-explosions occur which take off the contaminants from the rod.

SUMMARY

Certain aspects of the inventions disclosed herein pertain to a method for removing contaminates from a used sucker rod, the method comprising the steps of: obtaining a used sucker rod; placing the sucker rod on a support; placing a non-toxic solid particles delivery nozzle toward the sucker rod; delivering non-toxic solid particles to the surface of the sucker rod; and wherein contaminants are removed from the used sucker rod by kinetic energy that blasts the contaminants away from the rod; by thermal shock that weakens the contaminants by dropping the temperature of the contaminants; by thermal-kinetic energy that causes vapor from sublimation to expand and causes micro explosions which remove the contaminants; or some combination thereof.

In further embodiments concerning the cleaning of the sucker rods, the cleaning further comprises bombarding the sucker rod with non-toxic solid particles capable of sublimation at a pressure of 1 bar and a temperature of 0° C. or greater. In such embodiments, the solid particles may be methane or carbon dioxide. In preferred embodiments, the solid material is carbon dioxide.

In further embodiments concerning the non-toxic solid particles, the non-toxic solid particles may be pre-formed into a solid shape and propelled under pressure through a nozzle to deliver the non-toxic solid particles to the rod.

In other embodiments concerning the non-toxic solid particles are a liquid under pressure prior to being propelled under pressure through a nozzle to deliver non-toxic solid particles to the rod.

In embodiments wherein the non-toxic solid particles are solid carbon dioxide, the particles may have a diameter of about 3 mm to about 7 mm.

In further embodiments of the invention, after contaminants are removed, the contaminants are collected in a receptacle and discarded.

In still further embodiments of the invention the solid non-toxic solid particles are propelled from the nozzle at a pressure of about 80 psi to about 300 psi.

In other aspects of the invention, the solid non-toxic solid particles are propelled from the nozzle at a rate of about 50 to about 150 cubic feet per minute.

In aspects of the invention concerning delivering the non-toxic particles, the delivering may comprise delivering the non-toxic solid particles through a handheld nozzle.

In aspects of the invention concerning delivering the non-toxic particles, the delivering may comprise delivering the non-toxic solid particles through one or more nozzles in a fixed configuration.

In aspects of the invention concerning delivering the non-toxic particles, the delivering may comprise delivering the non-toxic solid particles through one or more nozzles in a fixed configuration that move relative to the rod and bombard the rod with the non-toxic solid particles.

In aspects of the invention concerning delivering the non-toxic particles, the delivering may comprise delivering the non-toxic solid particles in a fixed configuration wherein the rod moves relative to the nozzles.

In aspects of the invention pertaining to the treatment and reclamation of rods, the methods may further comprise performing a non-visual inspection of the used sucker rod to determine if the sucker rod is amenable to reconditioning.

In aspects of the invention pertaining to the treatment and reclamation of rods, the methods may further comprise categorizing the sucker rod into a steel class.

In aspects of the invention pertaining to the treatment and reclamation of rods, the methods may further comprise heating the rod until the rod is able to undergo plastic deformation and shaping the rod.

In aspects of the invention pertaining to the treatment and reclamation of rods, the methods may further comprise that wherein upon shaping the rod, the rod has an increased length and the rod is cut into two rods which may be used as sucker rods.

In aspects of the invention pertaining to the treatment and reclamation of rods, the methods may further comprise that wherein upon shaping the rod, the rod has an increased length and the rod is cut into a shorter rod and a pony rod.

In aspects of the invention pertaining to the treatment and reclamation of rods, the methods may further comprise that wherein after shaping the rod, the rod is subjected to shot peening.

Figure 1:
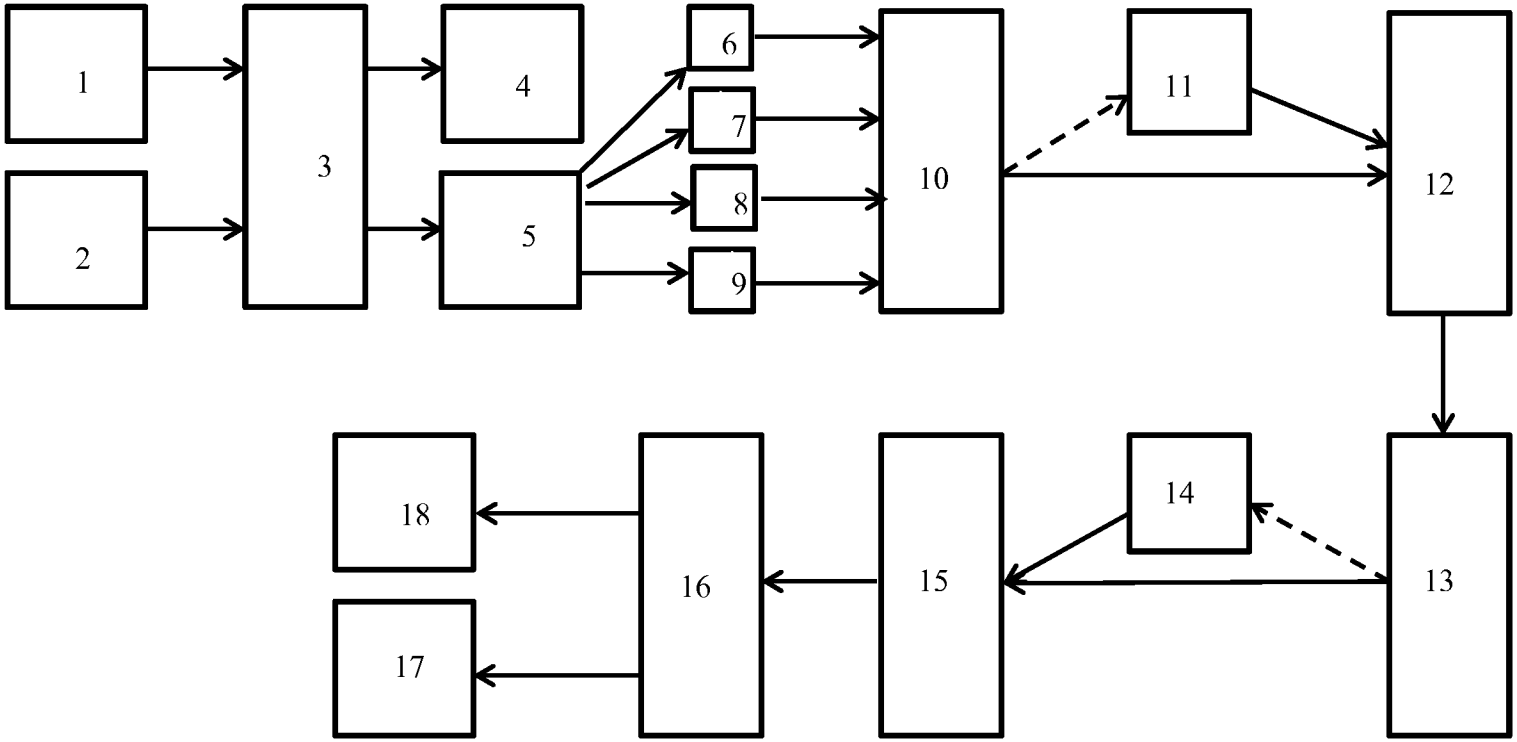
FIG. 1 is a flow chart of an embodiment of a method of reconditioning sucker rods, and wherein solid arrows are generally required and dashed arrows are optional.
Figure 2:
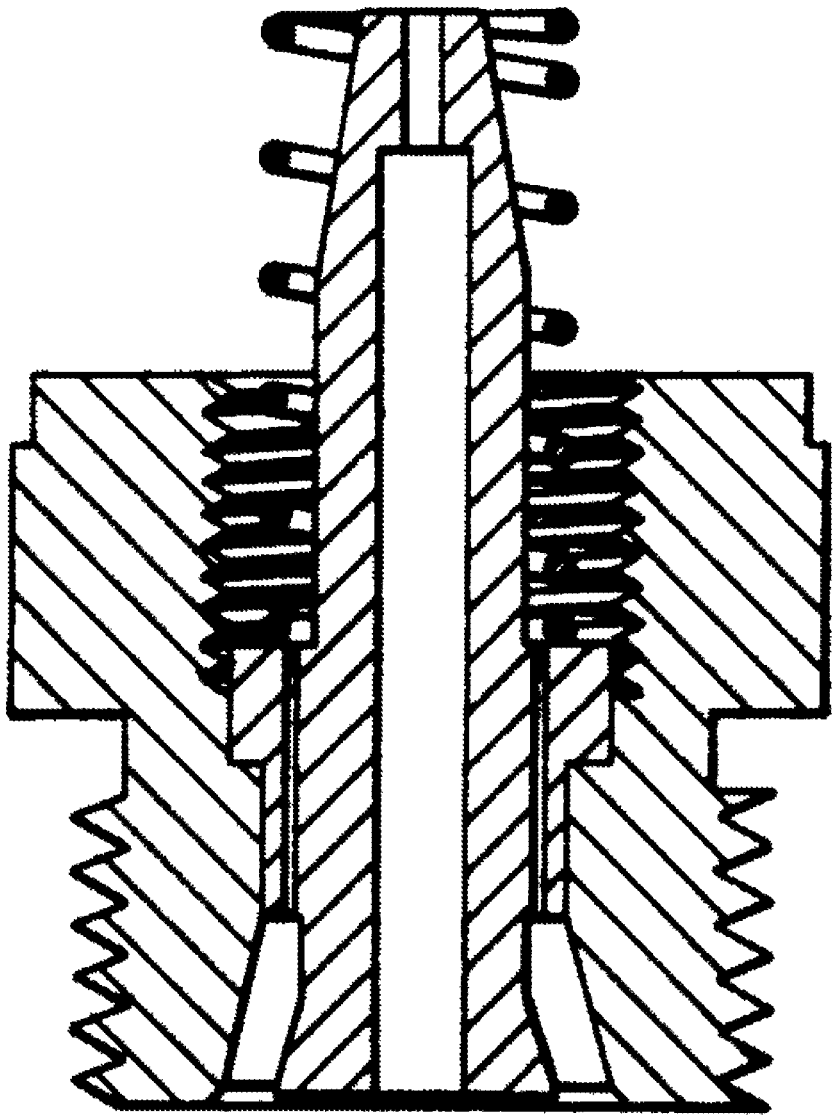
FIG. 2 is a prior art illustration of a phase change injection nozzle that causes a phase change of carbon dioxide from a liquid state to a solid state by flowing pressurized liquid carbon dioxide through an orifice.
Figure 3:
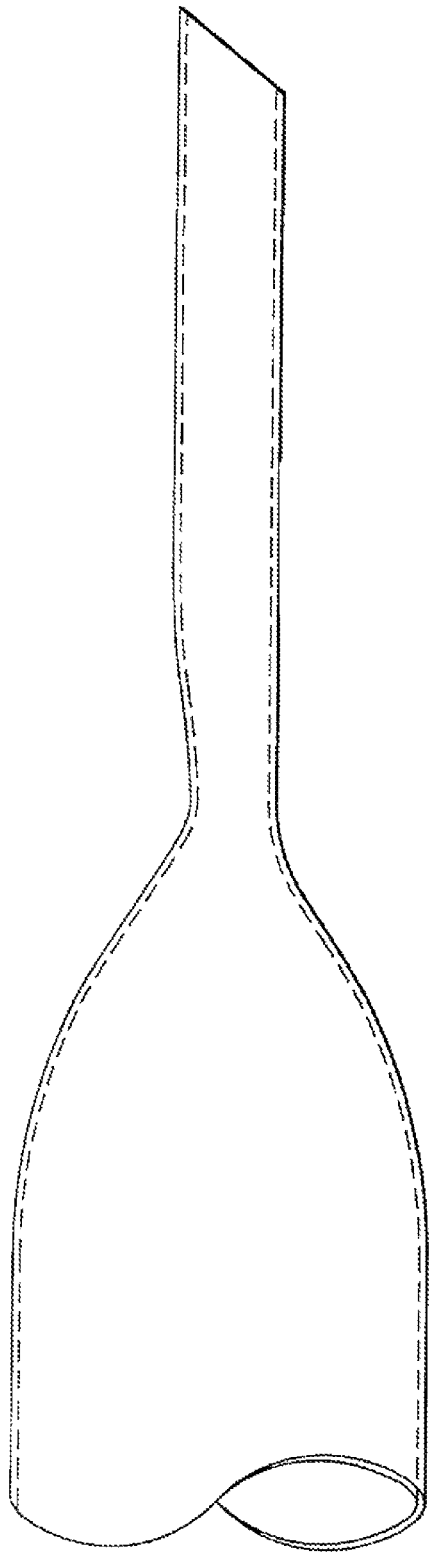
FIG. 3 is a prior art illustration of a supersonic nozzle used in particle blasting dry ice.
Figure 4:
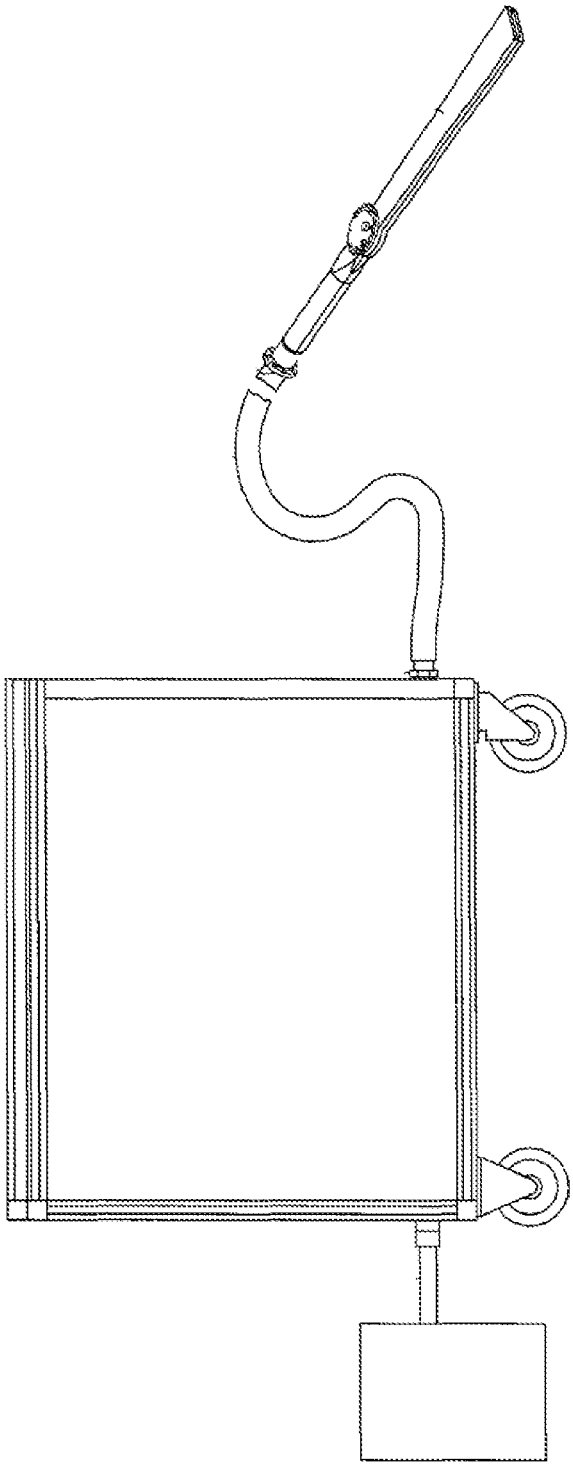
FIG. 4 is a prior art illustration of an isometric view of a media blasting apparatus with an attached converging diverging nozzle device for ejecting compressed air and media particles therefrom, the attached nozzle device further having a media size changer.

LIST OF REFERENCE NUMERALS collection process 1
shipment process 2
presortment 3
discarding process 4
grade sortment procedure 5
C 6
D 7
KD 8
High Strength 9
cleaning procedure 10.
rod straightening machine 11
induction furnace 12
pressure machine 13
shot peening 14
cutting procedure 15
final inspection process 16
outside manufacturer 17
factory forging 18

DETAILED DESCRIPTION

Introduction

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings making apparent to those skilled in the art how the several forms of the invention may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

As used herein, the term "sorting" means to arrange according to class, kind, and/or size; to classify.

As used herein, the term "rod" may include hollow or solid rods, continuous rods or joints, and includes welded, flanged, screwed, and other rod goods. In particular, sucker rod joints are one type of rod which may benefit from the methods described herein, but the disclosure is not so limited.

As used herein, the term "used rod" means a rod that has been in actual service for a purpose, such as transporting fluids, connecting a downhole pump to a surface driver, and the like, whether on the surface, downhole, underwater, onshore, or off-shore. In particular, in the case of sucker rods, used sucker rods are those that may be lifted to a holding area where they are uniquely identified according to size, quantity, company name and well location and tagged appropriately.

As used herein, the phrase "performing non-visual, non-destructive inspection" means a technique which does not impair the rods from performing their intended function or use, and does not involve a human visual test.

It is a goal of the present invention to remanufacture standard sized rods such as sucker rods by methods which include reheating of the rod body up to a particular temperature and applying pressure in conditions favorable for plastic deformation.

Embodiments

It is a goal of the present invention to remanufacture standard sized rods such as sucker rods by methods which include reheating of the rod body up to a particular temperature and applying pressure in conditions favorable for plastic deformation.

Still further, it is a goal of the present invention to clean the rod devices. Following cleaning, it is a goal of the present invention to presort the rods, such as sucker rods, by grade and quality. Following assortment, the methods disclosed herein contemplate cleaning the rod devices. Following cleaning, the methods disclosed herein contemplate straightening the rod devices. Following straightening the rod devices, the methods disclosed herein contemplate subjecting the rod devices to heating to the point wherein plastic deformation may occur and pressure for shaping. Following the heating process, the methods disclosed herein contemplate subjecting the rod devices to a rolling mill. Following subjecting the rod devices to a rolling mill, the methods disclosed herein contemplate straightening the rods again if necessary.

Regarding the cleaning of rod devices, in certain embodiments, it is a goal to freeze the contaminants on the rod such that they fall off the rod into a contaminate catch area. Alternatively, it is a goal to freeze the contaminants such that vibration, impact or movement results in the contaminants separating from the rod. Still further, in certain embodiments, it is a goal of the invention to freeze the contaminants on the rod such that the freezing causes expansion or contraction of the contaminants such that the expansion or contraction results in disassociation of the contaminants from the rod.

Further regarding the cleaning of rod devices, in certain embodiments regarding freezing the contaminates of the rod, it is a goal of the present invention that the freezing chemical or chemical compound is non-toxic to the environment or with respect to the Environmental Protection Agency of the United States. In certain embodiments, the freezing agent is a solid, such as an ice or a compound that is solid at temperatures at or below the freezing point of water.

In certain embodiments, wherein the freezing agent is a solid, the freezing agent may be any non-toxic solid such as a mineral compound, a non-metallic element such as silicon, a metallic compound such as iron, a metal alloy such as steel, or a non-metallic compound such as silicon dioxide.

In preferable embodiments, the freezing agent, when used as a solid to clean the rods, is a gas at 1 bar and 25° C. Preferable examples of solids which exist as gasses at 1 bar and 25° C. include carbon dioxide.

In certain embodiments related to the removal of contaminates from the rods, it is an object of the invention that the contaminants are frozen and become brittle or expand, thus causing them to disassociate from the rods.

In certain other embodiments related to the removal of contaminants from the rods, it is an object of the invention that the chemical agent such as dry ice involved in the cleaning of the rods is delivered to the rods at a high speed to remove the contaminants through chemical pressure on the rods.

In certain further embodiments, it is an object of the invention to provide methods of recovery of the contaminants such that they are not deposited at the cleaning site or released into the environment. It is an object of the invention that a tray or trough be placed under the rod being cleaned in certain embodiments. It is another object of the invention that vacuum pressure be placed under the rod being cleaned.

In further embodiments, it is an object of the invention that the nozzle spraying the rod is capable of moving up and down the rod from end to end to spray cleaning agent on the rod. It is a further object of the invention that the nozzle spraying the rod is capable of moving in substantially a 360 degree rotation around the rod in order to spray the rod with a cleaning agent evenly.

Conversely, in other embodiments, it is an object of the invention that the rod is rotatable with respect to a stationary nozzle or a nozzle which does not rotate around the rod. In such embodiments, the rotatable rod is able to receive the cleaning agent evenly. In further embodiments, it is an object of the invention that the rod is movable in an axial direction toward the ends of the rod. In some instances, this is perpendicular to the direction of the spray of a cleaning agent. In still further embodiments, it is an object of the invention that the rod is rotatable and also movable in an axial direction.

In still further embodiments, it is an object of the invention that a user holding a hand held nozzle will spray the cleaning agent onto the rod.

In still further embodiments regarding the nozzle, it is a further object of the invention that the cleaning apparatus has multiple nozzles. In still further embodiments, it is a further object of the invention that wherein the cleaning apparatus has multiple nozzles, the nozzles are within the same axis which is parallel to the rod. In other embodiments, the nozzles are in an axis which is perpendicular to the rod axis and surrounds or substantially surrounds the rod. In certain further embodiments, the nozzles are diagonal with respect to the rod axis and either surround or substantially surround the rod. In certain further embodiments, the nozzles are spaced randomly and may be substantially perpendicular to the rod axis, or in the alternative may surround or at least partially surround the rod.

In embodiments concerning the nozzle shape, the nozzle may expand from a cleaning source such that the diameter or area of a cleaning source hose is less than the diameter of the terminal end of the nozzle facing the rod.

In other embodiments concerning nozzle shape, the nozzle may contract from a cleaning source such that the diameter or area of a cleaning source hose, through which the cleaning material flows before exiting into the nozzle is greater than the diameter of the of the terminal end of the nozzle facing the rod. Still further, in other embodiments, the nozzle is the same size in diameter as the cleaning source hose.

In still other embodiments concerning nozzle shape, the terminal end of the nozzle facing the rod may have multiple bores for the cleaning material to exit. In other embodiments, it is the object of the invention that the nozzle shape is such that there is an annular ring around the nozzle facing in an inward direction to focus the cleaning material to a certain point on the rod. Likewise, in other embodiments, it is the object of the invention that the nozzle shape is such that there is an annular ring around the nozzle facing in an outward direction to spread the cleaning material in an efficient manner to a large area of the rod to be cleaned.

Nozzles for use in dry ice blasting are known in the art. Such nozzles can be found in U.S. Pat. Nos. 5,018,667; 5,660,580 and 8,187,057; each of which are specifically incorporated by reference in their entirety.

In embodiments concerning the cleaning material, it is sometimes an object of the invention that the cleaning material exiting the nozzle is a solid. In such embodiments, the cleaning material may be an elemental metal, a metal alloy, a non-metallic mineral or a solid which undergoes sublimation. In preferred embodiments, the cleaning agent is a solid which undergoes sublimation such as solid carbon dioxide, otherwise known as dry ice.

In embodiments concerning dry ice as a cleaning material, the material may be shaped in amorphous form. In other embodiments, the dry ice may be shaped in roughly a cylindrical form. In other embodiments, the dry ice is shaped in an oval form. In still further embodiments, the dry ice is shaped in a spherical form.

The size of the dry ice used in the cleaning process may vary per application, rod type, rod durability, for example, aluminum versus steel, contaminant type, the time needed for sublimation to occur and other factors. The size of the dry ice may be less than 1 mm in diameter such that it is in a powder form. Additionally, the size of the dry ice may be 2 mm, 3 mm, 4 mm, 5 mm, 6 mm, 7 mm, 8 mm, 9 mm, 10 mm or more in diameter.

In embodiments concerning the application of the dry ice or other cleaning material to the rod, the cleaning material may be pressurized such that it contacts the rod at a desired speed. The pressure may be any pressure contemplated that propels the cleaning material to the rod. In certain embodiments, the pressure is 10 psi, 20, psi, 30 psi, 40 psi, 50, psi, 60 psi, 70 psi, 80 psi, 90 psi, 100, 200, 300, 400, 500, 600, 700, 800, 900, 1000 or more psi.

In certain embodiments wherein the rod is subjected to cleaning by bombardment with cleaning agents which induce freezing of contaminants, the dry ice impacting a sucker rod or other pump rod surface with contaminants typically removes contaminates in one of three ways: via kinetic energy, via thermal shock or via a thermal-kinetic effect. Kinetic energy transfers the accelerated dry ice pellet as it hits the surface of the rod to be cleaned during the dry ice blasting process. The dry ice pellets sublimate upon impact. Likewise, thermal shock occurs when dry ice pellets strike a much warmer contaminated surface during the dry ice blasting. The cold temperature of the dry ice causes the bond between the surface being cleaned and the contaminants to weaken. This effect aids in the release of the contaminant when struck by the dry ice pellets during dry ice blasting. The thermal-kinetic effect combines the impact of sublimation and the rapid heat transfer discussed above. When the dry ice pellet hits the contaminated surface, the vapor expands fast enough that micro-explosions occur which take off the contaminants from the rod.

Implementation

Cleaning

Typically, before inspection to sort out unacceptable rods from rods which are able to function for their intended purpose, the rods are cleaned. Typically, in most embodiments of the invention, the used rods are cleaned in a hot kerosene bath to remove paraffin, grease and other foreign materials.

However, in certain embodiments the cleaning process may be to subject the rods to pressure washing, either with water or with other solvents such as inorganic solvents such as acid baths and the like or organic solvents. Organic solvents contemplated may include benzene, ether, gasoline, acetone and the like. Further, it is contemplated that in some embodiments, the cleaning process with certain organic or inorganic solvents may not require the solvents to be blasted against the rods via pressure washing but rather the rods may be dipped, submerged, or subject to low pressure wetting of such solvents in order to clean the rods.

In still further embodiments, the rods may be shot blasted with sand, polystyrene, glass and the like to remove paraffin, grease and other foreign materials.

It is further contemplated that dry ice cleaning may be used. In such embodiments, the rod may be subjected to being blasted with dry ice or surrounded with dry ice in order to remove the aforementioned contaminates. A particular advantage of the use of dry ice is the lack of flammability associated with the use of organic solvents such as kerosene, acetone and the like. An additional advantage of dry ice cleaning is the lack of cleanup of the cleaning material as dry ice sublimates at room temperature and normal atmospheric pressure (1 bar). However, it may be necessary to provide adequate ventilation should workers be present in order to avoid carbon dioxide poisoning.

Once the rods are clean, typically in most embodiments of the invention, they are subjected to presortment.

In implementation, the cleaning process is used to provide a cleaned surface for the inspection of the pump rods such as sucker rods. Inspections include one or more of the following: visual inspection, electromagnetic inspection, eddy current inspections, etc. The inspection process is performed to detect defects and anomalies in the rods such as sucker rods First, in the process rods are inspected in a plant setting by the segregation of the rods into same size material. The rods can be segregated by specific wells for customers who are inspecting used rods to reclaim the rods for re-use. The new rod inspections may take place to "spot check" quantities of rods, or to inspect the entire quantity of sucker rods for customers or for manufacturers to insure the quality of the product.

Used rod inspection is performed to recover as many reusable rods again in down hole applications. Used rods that meet the criteria for acceptance can save oil companies money by re-using acceptable rods and not purchasing new rods.

The process of cleaning the sucker rods and products begins by one of two methods. One is cleaning the sucker rods by use of a manual hand held handle with a nozzle to direct the flow of dry ice particles onto the surface of the rods. The other method is to have a fixed apparatus to hold the nozzles in place, and the rods are conveyed thru the forced stream of dry ice particles to clean the surface of the sucker rods.

This process uses dry ice pellets (typically ranging in size of ⅛" to ¼"), a dry ice blasting machine, and an air pressure source.

The dry ice pellets can either be manufactured with pelletizing equipment on site or can be brought in from an outside source. Pellets that are brought in from an outside source are typically stored in an insulated container until ready for use. Pellets that are manufactured on site typically require that a supply of liquid carbon dioxide is available, usually in a storage tank. The liquid carbon dioxide is piped into the pelletizer which typically changes the liquid carbon dioxide into a solid ice pellet.

In implementation, the pelletizer is directly connected to the dry ice blaster. Alternatively it can be a stand-alone unit. However, with either system, the ice pellets are placed into the dry ice blaster. In implementation dry ice blaster is connected to an air compressor source that typically produces a pressure of 100 psi at 80 cfm to provide the energy to force the ice pellets onto the surface of the sucker rod. The dry ice blaster keeps the pellets contained until they are fed into the cleaning source hose that is attached to the designed nozzle to provide the desired pattern and coverage of the blast stream to effectively remove the unwanted debris from the surface of the rod. The debris that is removed from the surface of the rods is captured into an enclosed cabinet or tray that will be disposed of according to regulatory requirements. The sucker rod coupling can remain attached to the rod through this cleaning process or can be removed prior to the commencement of the cleaning process. If the coupling remains attached to the sucker rod, the surface of the sucker rod is cleaned. The rod is dry and cleaned and ready for the inspection processes to begin.

More specifically, in implementation the rods are laid on a rack that feeds into a transfer conveyor. The visibly damaged rods are removed immediately. The remaining rods feed onto the conveyor which will convey the rods into an area designed to accommodate the dry ice blasting. The rods travel into the semi-enclosed cabinet with the dry ice nozzles aligned to maximize the cleaning of the outer surface of the sucker rods. The rods can be conveyed thru the cleaning cabinet in single rod at a time or can be multiple rods at a time. As the rods travel thru the cleaning cabinet the dry ice pellets are propelled from the dry ice blaster thru a hose to the nozzles which direct the pattern to adequately clean the surface of the rods, the bare pin threads, and the coupling (if still attached).

In implementation, the residue and debris on the outer surface of the rods, threads, and couplings is contained inside the cleaning cabinet to prevent the material from being scattered through-out the plant or area where the cleaning is being performed. A container is placed at the bottom of the cabinet to capture this debris for ease of disposal. The nozzles are directed in a manner so that the blast stream of air and dry ice pellets cleans the bare threads of the connecting threads, as well as the rod body and coupling body surfaces.

After this step in the cleaning process is completed, the rods are conveyed into the inspection plant. At this point the couplings, if attached to the rods, are removed. The coupling outer surface has been cleaned, and a lance with proprietary angles designed to deflect the dry ice pellets at an angle to clean the inside diameter of the couplings is used to complete the cleaning process for the couplings. Two more smaller cleaning cabinets are used to clean the pin connecting thread on each end of the sucker rod, that was enclosed inside the coupling, with the dry ice blasting equipment with same size pellets.

Presortment

In implementation, rods are collected from petroleum producing sites and brought to a central location for inspection prior to any reconditioning or remanufacturing processes. Visual inspection is typically the first step in the convention reclamation and reconditioning processes.

Typically, the process of visual inspection typically involves a person visually locating pitting, corrosion, wear, stretched rods and bent rods. Any rod which fails to pass this visual inspection may be removed from the aforementioned central location as rejected.

However, despite visual inspection, even clean rods may have unseen defects such as cracks that result in such rods being unacceptable for their intended use. Accordingly, sometimes other methods of inspection are used.

In many embodiments of the invention, the methods comprise performing non-visual or non-destructive inspection of used rods prior to any straightening as discussed below.

In order to inspect the rods in a non-visual manner, methods of the invention may include passing used rods through one or more stationary inspection stations. Alternatively one or more inspection apparatus may be moved along stationary rods. Alternatively, both the used rods and inspection apparatus may move.

In certain embodiments of the invention pertaining to non-visual inspection, magnetic flux leakage inspection may be used. Such methods typically involve the use of a magnetic coil and a detector assembly for inspecting the rods. Such systems typically employ one or more magnetic detectors adapted to be spaced a first distance from the rod member by one or more substantially frictionless members during an inspection. Methods specifically pertaining to magnetic flux leakage inspection may be found in U.S. Pat. No. 7,397,238, which is herein incorporated by reference in its entirety. In alternative embodiments of the invention, other suitable non-visual, non-destructive inspections include, but are not limited to: ultrasonic inspection, eddy current inspection, acoustic emission inspection, and the like. Furthermore, the data from such tests may be presented in one or more formats, including visual format, such as on a CRT screen, flat panel screen, printer, strip chart recorder and the like.

Additionally, in addition to the detection of flaws, the rods, in certain embodiments may be separated in to grades of steel. In such embodiments, it may be beneficial to determine the grade of the steel rod before any treatment occurs so as to know the physical constraints and properties of the end product. In such embodiments, the grades of steel are typically divided into the following: Class C steel, Class D steel, Class KD steel, and High Strength steel. Within the classes, Class D steel is typically divided by alloy D and carbon D.

Straightening

Typically, in many embodiments of the invention, rods that have not been rejected, but that are bent or still possess rod guides are sent to a rod straightening machine and/or a rod guide removal machine. Typically, in many embodiments of the invention, once the rods have been straightened and no longer have rod guides, they may be returned to the aforementioned central location.

Heating and Shaping

In certain embodiments of the invention, upon straightening of used rods, the rods are subjected to heating. In such embodiments, a rod such as a sucker rod in need of reclamation is heated to a temperature favorable for plastic deformation of the rod. In the case of steel, the temperature may be within the range of about 900° C. to about 1300° C. This temperature range is known to be used for treating steel alloys through forging, rolling, deformation and the like. Still further in implementation, at the same time the rod is being heated to a temperature favorable for plastic deformation, a hot recrystallization of the rod takes place which eliminates inner stress of the rod that has accumulated during the course of the rod's operational life.

In certain embodiments the desired geometry of the used rods is obtained by treatment under pressure. In such embodiments, the cross sectional area of the rod may be varied while the standard length of the rod is maintained. In such embodiments, mechanical properties of rods may be enhanced during the pressure treatment such that a rod is structurally stronger in its peripheral zone. For example, by the reheating the rod body up to a temperature which would allow it to undergo plastic deformation under pressure, the rod may be structurally stronger in the peripheral zone as compared to rods treated by other methods of reclamation. Additionally, the high temperature used to make the rod favorable for plastic deformation also allows the rod to be reshaped to the correct geometric form as before without any defects caused in the operations such as cracks or cavities.

In further embodiments, reheating the rod is specifically achieved through the use of an induction furnace. As is known in the art, an induction furnace is an electrical furnace in which the heat is applied by induction heating of metal. The advantage of the induction furnace is a clean, energy-efficient and well-controllable melting process compared to most other means of metal melting. Since no arc or combustion is used, the temperature of the rod can be set such that it is no higher than what is required to make it amenable to plastic deformation; this can prevent loss of valuable alloying elements. Operating frequencies range from utility frequency (50 or 60 Hz) to 400 kHz or higher, usually depending on the material being melted, the capacity of the furnace and the melting speed required. Generally, the smaller the volume of the melts, the higher the frequency of the furnace used; this is due to the skin depth which is a measure of the distance an alternating current can penetrate beneath the surface of a conductor. For the same conductivity, the higher frequencies have a shallow skin depth, in other words, that is less penetration into the melt. Lower frequencies can generate stifling or turbulence in the metal.

In still further embodiments, upon heating the used rod to a temperature favorable for plastic deformation, the used rod can be treated under pressure, typically by radial-helical rolling. As a sucker rod or pump rod is an elongated bar shape, under pressure treatment the cross-sectional diameter of the rod will decrease such that the rod can be reformed into the next smaller standard size if desired. After plastic deformation, besides shrinking the cross-sectional area, the length of the rod will be increased if the mass of the metal remains constant or near constant. Typically, the reduction in diameter is one size down in terms of standard rod size. However, reduction by several sizes would allow two sucker rods to be produced out of one parent sucker rod. The standard sizes for sucker rods in English measurements are 1", ⅞", ¾", and ⅝".

As the heating and shaping increases the length, the rods may be cut before the heating and shaping to remove the ends. Typically processed in one of two ways. In the first way, the rods may simply have the ends cut off so that the rods are cut to the correct length and the remaining steel can be used to make pony rods. Alternatively, the ends can be cut off plus additional footage in the body of the rod in order to produce new bar stock that is the length needed to produce a new sucker rod.

After treatment via plastic deformation, the rods, such as sucker rods may be raw bar stock that can be sold to users or other manufacturers in the petroleum industry. These rods can be made to a standardized length again by cold chiseling, abrasive cutting or both.

In this embodiment, the users or other manufacturers may forge the ends of the sucker rods to fit their particular equipment needs.

Shot Peening

Upon reformation, the rod is then cooled and stored for use or further treatments.

In certain embodiments, after cooling the rod, such as a sucker rod is subjected to shot peening. Shot peening is a cold working process in which the surface is bombarded with small spherical media called shot. As each individual shot particle strikes the surface, it produces a slight rounded depression. Plastic flow and radial stretching of the surface metal occur at the instant of contact and the edges of the depression rise slightly above the original surface. Benefits obtained by shot peening are the result of the effect of the compressive stress and the cold working induced. Compressive stresses are beneficial in increasing resistance to fatigue failures, corrosion fatigue, stress corrosion cracking, and hydrogen assisted cracking. Shot peening is effective in reducing sucker rod fatigue failures caused by cyclic loading. Stress corrosion cracking cannot occur in an area of compressive stress. The compressive stresses induced by shot peening can effectively overcome the surface tensile stresses that cause stress corrosion. Shot peening has been shown to be effective in retarding the migration of hydrogen through metal. Shot peening improves the surface integrity of the sucker rod. As peening cold-works the rod surface, it blends small surface imperfections and effectively eliminates them as stress concentration points.

Final Inspection

In certain embodiments of the invention, following the sorting, cleaning, straightening, heating and shaping of the rods, the rods are subject to a final inspection. Typically such inspection is eddy current inspection. Eddy-current inspection uses electromagnetic induction to detect flaws in conductive materials. In a standard eddy current inspection a circular coil carrying current is placed in proximity to the sucker rod. The alternating current in the coil generates changing magnetic field which interacts with sucker rod and generates an eddy current. Variations in the phase and magnitude of these eddy currents can be monitored using a second receiver coil, or by measuring changes to the current flowing in the primary coil. Variations in the electrical conductivity or magnetic permeability of the test object, or the presence of any flaws, will cause a change in eddy current and a corresponding change in the phase and amplitude of the measured current.

Summary of Implementation

In implementation of the aforementioned embodiments and methods, and referring to FIG. 1, rods, hereinafter for simplicity referred to as sucker rods, are collected from upstream petroleum producing sites via a collection process 1. Alternatively, the sucker rods may be shipped to a common location via a shipment process 2. The sucker rods are then subjected to presortment 3. First, the sucker rods are scanned through non-visual magnetic flux leakage inspection to sort out flaws in the sucker rods. Sucker rods which have failed inspection are subject to a discarding process 4. Sucker rods which have not failed this inspection are subjected to a grade sortment procedure 5 to sort out the grade of steel, such as C 6, D 7, KD 8 and High Strength 9. Sucker rods which have not failed inspection due to extensive cracks or extensive corrosion, and have been sorted are then subjected to a cleaning procedure 10.

In a preferred implementation, the sucker rods, separated by grade of steel, are taken to a plant. Each grade of sucker rods is treated in turn. In the plant, the sucker rods are first cleaned.

After cleaning, each sucker rod in need of straightening is subjected to a rod straightening machine 11. After straightening, the rods are capable of being heated and shaped.

In the step of heating and shaping, each rod is placed upon a conveyor which transports each sucker rod through an induction furnace 12 or a series of induction furnaces with a temperature of between about 900° C. to about 1300° C. The heating is designed not to melt the sucker rod but to soften each sucker rod to the point wherein plastic deformation is possible.

Following heating to the point wherein plastic deformation is possible, the sucker rod is subjected to a pressure machine 13 in order to smooth out any surface imperfections. This process compresses the sucker rod such that the cross sectional area may be changed.

Upon shaping, the conveyor removes the sucker rod from the pressure machine and the sucker rod is allowed to cool. After cooling, the sucker rod may then be optionally subjected to shot peening 14. Regardless of whether the sucker rod is subjected to shot peening, the sucker rod may be optionally cut to a desired length through a cutting procedure 15. When cut to a desired length, the sucker rod is then subjected to a final inspection process 16. Generally, the inspection process is eddy current inspection. After inspection, the sucker rod is shipped to an outside manufacturer 17 in order to forge end pieces on the sucker rod for appropriate applications. Optionally, factory forging 18 may be done wherein the forging is done at the same location as where the rod is heated and shaped.

It should be appreciated by those of skill in the art that the techniques disclosed in the aforementioned embodiments represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit or scope of the invention.

The invention claimed is:

1. A method for removing contaminants from a used sucker rod, the method comprising the steps of:

a) obtaining a used sucker rod with contaminants;

b) removing said contaminants from the used sucker rod by bombarding the used sucker rod with non-toxic solid particles comprising methane or carbon dioxide, wherein said contaminants are removed from the used sucker rod by:

i) kinetic energy from the non-toxic solid particles, wherein said kinetic energy accelerates the non-toxic solid particles such that said contaminants are blasted away from the used sucker rod;

ii) thermal shock that weakens the contaminants by dropping a temperature of the contaminants;

iii) thermal-kinetic energy that causes vapor to form from sublimation of the non-toxic solid particles upon impact with said contaminants, wherein the vapor expands and causes micro explosions which remove the contaminants; or iv) combinations thereof;

c) heating the sucker rod until the rod is able to undergo plastic deformation;

d) shaping the sucker rod; and e) after step d), subjecting the sucker rod to shot peening or shot blasting.

2. The method of claim 1, wherein the non-toxic solid particles are capable of said sublimation at a pressure of 1 bar and a temperature of 0° C. or greater.

3. The method of claim 1, wherein the non-toxic solid particles are comprised of carbon dioxide.

4. The method of claim 1, wherein the solid carbon dioxide has a diameter of about 3 mm to about 7 mm.

5. The method of claim 1, wherein after the contaminants are removed, the contaminants are collected in a receptacle and discarded.

6. The method of claim 1, further comprising propelling the non-toxic solid particles toward the sucker rod from a nozzle at a pressure of about 80 psi to about 300 psi.

7. The method of claim 1, further comprising propelling the non-toxic solid particles toward the sucker rod from a nozzle at a rate of about 50 to about 150 cubic feet per minute.

8. The method of claim 1, further comprising providing a handheld nozzle to deliver the non-toxic solid particles to the sucker rod.

9. The method of claim 1, further comprising providing one or more nozzles in a fixed configuration to deliver the non-toxic solid particles to the sucker rod.

10. The method of claim 1, further comprising performing a non-visual inspection of the used sucker rod to determine if the sucker rod is amenable to reconditioning.

11. The method of claim 1, wherein upon shaping the rod, the rod has an increased length and the rod is cut into two rods which may be used as sucker rods.

12. The method of claim 1, wherein upon shaping the rod, the rod has an increased length and the rod is cut into a shorter rod and a pony rod.

13. The method of clam 2, wherein the non-toxic solid particles are pre-formed into a solid shape and propelled under pressure through a nozzle to deliver the non-toxic solid particles to the rod.

14. The method of claim 2, wherein the non-toxic solid particles are a liquid under pressure prior to being propelled under pressure through a nozzle to deliver the non-toxic solid particles to the rod.

15. The method of claim 9, wherein the one or more nozzles in a fixed configuration move relative to the rod and bombard the rod with the non-toxic solid particles.

16. The method of claim 9, wherein the one or more nozzles are in a fixed configuration and the rod moves relative to the nozzles.

* * * * *